US006843175B2

(12) United States Patent
Kawauchi et al.

(10) Patent No.: US 6,843,175 B2
(45) Date of Patent: Jan. 18, 2005

(54) SUPPORT FOR LITHOGRAPHIC PRINTING PLATE AND PRESENSITIZED PLATE

(75) Inventors: Ikuo Kawauchi, Shizuoka (JP); Tadashi Endo, Shizuoka (JP); Hiroji Tokunaga, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 312 days.

(21) Appl. No.: 10/118,213

(22) Filed: Apr. 9, 2002

(65) Prior Publication Data

US 2003/0084807 A1 May 8, 2003

(30) Foreign Application Priority Data

Apr. 20, 2001 (JP) ..... 2001-121864

(51) Int. Cl.[7] ..... B41N 3/00
(52) U.S. Cl. ..... 101/458; 101/455; 205/153
(58) Field of Search ..... 101/455, 458, 101/459; 205/139, 153, 201

(56) References Cited

U.S. PATENT DOCUMENTS

| | | | | | |
|---|---|---|---|---|---|
| 2,714,066 | A | | 7/1955 | Jewett et al. | |
| 3,181,461 | A | | 5/1965 | Fromson | |
| 4,492,616 | A | * | 1/1985 | Pliefke et al. | 205/214 |
| 5,480,762 | A | * | 1/1996 | Toyama et al. | 430/302 |
| 5,556,531 | A | * | 9/1996 | Wiedemann | 205/153 |
| 6,105,500 | A | * | 8/2000 | Bhambra et al. | 101/455 |
| 6,238,839 | B1 | * | 5/2001 | Tomita et al. | 430/278.1 |

* cited by examiner

*Primary Examiner*—Daniel J. Colilla
*Assistant Examiner*—Jill E. Culler
(74) *Attorney, Agent, or Firm*—Sughrue Mion, PLLC

(57) ABSTRACT

A support for a lithographic printing plate, wherein scum resistance is improved when processed into a lithographic printing plate by performing treatment for water wettablity and, in addition, press life is excellent. A support for a lithographic printing plate, which is obtained by performing at least anodizing treatment and silicate treatment on an aluminum plate, wherein a ratio of the number of atoms of alkali-earth metal and silicon existing on a surface thereof is 0.1 to 0.95.

6 Claims, No Drawings

SUPPORT FOR LITHOGRAPHIC PRINTING PLATE AND PRESENSITIZED PLATE

BACKGROUND OF THE INVENTION

The present invention relates to a support for a lithographic printing plate.

It has been known in the prior art that treatment for water wettability, typified by silicate treatment, is performed for a surface of a support for a lithographic printing plate after anodizing treatment in order to improve development performance of a presensitized plate. By performing the treatment for water wettability on the surface of a support for a lithographic printing plate, ink which is hydrophobic is hardly adheres to non-image areas of a lithographic printing plate in printing. Thus, scum resistance is improved.

However, by performing the treatment for water wettability on the surface of the support for the lithographic printing plate, adhesion of a hydrophobic photosensitive layer with a support in a presensitized plate is deteriorated, and when the presensitized plate is processed into a lithographic printing plate, press life thereof may be decreased sometimes.

Therefore, an object of the present invention is to provide a support for a lithographic printing plate, in which scum resistance is improved when the presensitized plate is processed into a lithographic printing plate by performing treatment for water wettablity and, in addition, press life is excellent.

SUMMARY OF THE INVENTION

The inventors of this application conducted an extensive study to achieve the object described above and found out that in a support for a lithographic printing plate obtained by performing anodizing treatment and silicate treatment on an aluminum plate, the press life can be improved by making ratio of a number of atoms of alkali-earth metal and silicon existing on its surface. In addition, the inventors found out that in the support for the lithographic printing plate obtained by performing anodizing treatment and treatment for water wettability on an aluminum plate, the press life can be improved by making 1 mg/m$^2$ or more of alkali-earth metal exist on the surface.

The inventors completed the present invention based on the knowledge mentioned above.

In short, a first aspect of the present invention is to provide a support for a lithographic printing plate which is obtained by performing anodizing treatment and silicate treatment on an aluminum plate, in which ratio of the number of atoms of alkali-earth metal and silicon existing on a surface thereof is 0.1 to 0.95.

The support for the lithographic printing plate should be preferably employed which is obtained by performing a water treatment using water containing 5 ppm or more of alkali-earth metal after the silicate treatment.

Also, a second aspect of the present invention is a support for a lithographic printing plate which is obtained by performing anodizing treatment and treatment for water wettability on an aluminum plate, wherein 1 mg/m$^2$ or more of alkali-earth metal exists on a surface thereof.

In the support for the lithographic printing plate according to the first and the second aspects of the present invention, specified amount of alkali-earth metal exists on the surface. This alkali-earth metal exists as a divalent cation on the surface of the support for the lithographic printing plate and it is conceivable that the alkali-earth metal may be bonded to $SiO_2$ and the like provided on the surface by treatment for water wettability. And conceivably this cation of the alkali-earth metal attracts electrically such polar groups each other as carboxy group, phenolic hydroxy group, sulfonamide existing in polymers and the like composing a photosensitive layer or a undercoat layer. Thus, adhesion of the photosensitive layer or the undercoat layer with the support are improved to provide excellent press life when it is processed into a lithographic printing plate.

Since in the present invention the press life is improved by a mechanism mentioned above, the effect to improve the press life is not large in a conventional negative working type in which a resin having a diazo group is used as a photosensitive layer or an undercoat layer. Thus, this invention is preferably used for manufacturing other presensitized plates besides that. For example, it is preferably used for manufacturing a conventional positive working type, a thermal positive working type and a thermal negative working type of the presensitized plate.

A support for a lithographic printing plate according to the present invention is excellent in scum resistance since treatment for water wettablity is performed on the lithographic printing plate and in addition, excellent in press life. The support for the lithographic printing plate according to the present invention is preferably used for production of, in particular, a conventional positive working type, thermal positive working type and thermal negative working type of presensitized plates.

DETAILED DESCRIPTION OF THE PREFERRED EMBODIMENTS

The present invention is described below in detail.

[A Support for a Lithographic Printing Plate]

<Aluminum Plate (Rolled Aluminum)>

An aluminum plate used for a support for a lithographic printing plate of the present invention is metal having dimensional stable aluminum as the main component and are composed of aluminum or aluminum alloy. Besides a pure aluminum plate, alloy with aluminum as the main component containing very small quantity of different elements, plastic film or paper laminated or vapor deposited with aluminum or aluminum alloy may be used. Further, as described in JP 48-18327 B (the term "JP XX-XXXXXX B" as used herein means an "examined Japanese patent publication"), a composite sheet in which an aluminum sheet is combined on a polyethylene terephthalate film may be used.

Hereinafter, various plates composed of aluminum or aluminum alloy described before are referred to as an aluminum plate as a generic name. Different elements that may be contained in the aluminum alloy are silicon, iron, manganese, copper, magnesium, chromium, zinc, bismuth, nickel, titanium and so on. The content in the aluminum alloy is 10 wt % or less. In particular, the copper content is preferably 0 to 0.05 wt %.

A pure aluminum plate is preferably used in the present invention, but since it is difficult to produce perfectly pure aluminum from the viewpoint of refining technology, aluminum containing tiny quantity of different elements may be allowable. Composition of the aluminum plate used in the present invention is not specified in this way and materials well-known before such as JIS A1050, JIS A1100, JIS A3005, JIS A3004, International registered alloy 3103A and the like may be used as occasion arises. With regard to a production method of an aluminum plate, continuous casting and DC casting can be used, and also an aluminum plate produced without an annealing process and soaking in the DC casting can be used. The aluminum plate having asperity by laminated rolling or transcription in the final rolling process may be used. Thickness of aluminum plates used in the present invention is around 0.1 to 0.6 mm. This thickness may be changed depending on size of a printing machine, size of a printing plate and user requires.

The support for a lithographic printing plate of the present invention is obtained by performing anodizing treatment and treatment for water wettability on the aluminum plate. Other various processes besides the anodizing treatment and treatment for water wettability may be included in the production process of the support.

<Surface Roughing Treatment (Graining Treatment)>

The foregoing aluminum plate has a preferable shape by performing graining treatment. As a graining treatment method, there is mechanical graining as described in JP 56-28893 A (the term "JP XX—XXXXXX A" as used herein means an "unexamined published Japanese patent application"), chemical etching, electrolytic graining and the like. Furthermore, an electrochemical graining (electrolytic graining) method graining a surface of aluminum in hydrochloric acid electrolytic solution or nitric acid electrolytic solution electrochemically, a mechanical graining method such as a wire brushing graining method scratching a surface of aluminum with metal wire, a ball graining method graining a surface of aluminum with abrasives and a graining ball, a brush graining method graining the surface with nylon brushes and abrasives and the like, may be used. These graining methods may be used alone or in combination of those such as combination of mechanical graining with nylon brushes and abrasives and combination of multiple electrolytic graining treatments.

In the case of a brush graining method, by selecting properly conditions such as an average diameter of particles used as an abrasive, the maximum diameter of the particles, diameters of bristles of the brush, density of the bristles, pressing pressure and the like, it is possible to control an average depth of concave portions in long wavelength components on the surface of an aluminum support. At the concave portions obtained by the brush graining method, the average wavelength is preferably 3 to 15 $\mu$m and average depth is preferably 0.3 to 1 $\mu$m.

Among those graining methods, a preferable method for making a grained surface used in the present invention is an electrochemical method graining the surface chemically in the hydrochloric acid electrolytic solution or nitric acid electrolytic solution. Preferable current density is 50 to 400 C/dm$^2$ at an anode electricity quantity. Further concretely, for example, it is carried out in electrolytic solution containing hydrochloric acid or nitric acid of 0.1 to 50 wt % under such conditions as at 20 to 100° C. of temperature, 1 second to 30 minutes of time and 100 to 400 C/dm$^2$ of current density, using direct current or alternating current. Since the electrochemical graining can easily process fine asperities on the surface, it is suitable for improving adhesion between the photosensitive layers and the support.

By the electrochemical graining after the mechanical graining, pits in the shape of crater or honeycomb with the average diameter of 0.3 to 1.5 $\mu$m and the average depth of 0.05 to 0.4 $\mu$m can be formed with an area ratio of 80 to 100%. In the case where only the electrochemical graining performed without the mechanical graining, the average depth is preferably less than 0.3 $\mu$m.

The pits formed have functions to improve scum resistance and press life of the non-image areas of the printing plates. In the electrolytic graining treatment, the quantity of electricity, that is, the product of electric current and running time for the current, which is required for forming adequate pits on the surface, is an important condition. It is desirable to form adequate pits by less amount of electricity from a viewpoint of energy saving.

Surface roughness after the graining treatment is preferably 0.2 to 0.5 $\mu$m at the arithmetic average roughness ($R_a$) measured at 0.8 mm of cut-off value, 3.0 mm of evaluation length in accordance with JIS B0601-1994.

<Chemical Etching Treatment>

It is preferable that chemical etching is performed on a graining-treated aluminum plate in the above-described manner. As the chemical etching, etching with an acid and etching with an alkali are known. As an especially excellent method in terms of etching efficiency, a chemical etching using an alkali solution is enumerated.

An alkali agent used suitably in the present invention includes sodium hydroxide, sodium carbonate, sodium aluminate, sodium metasilicate, sodium phosphate, potassium hydroxide, lithium hydroxide but not limited to these.

The alkali etching is preferably performed in the condition that dissolving amount of Al is 0.05 to 1.0 g/m$^2$ As other conditions are also not limited, alkali concentration is preferably 1 to 50 wt %, more preferably 5 to 30 wt % and alkali temperature is preferably 20 to 100° C., more preferably 30 to 50° C. The alkali etching is not limited to one method but combination of multiple methods may be used.

Then, in this invention, alkali etching may be performed after mechanical graining and before electrochemical graining. In this case dissolving amount of Al is preferably 0.05 to 30 g/m$^2$.

After the alkali etching treatment, washing with acid is carried out to remove smut remained on the surface. Acid to be used includes, for example, nitric acid, sulfuric acid, phosphoric acid, chromic acid, hydrofluoric acid and borofluoric acid. In particular, as a method for removing smut after electrolytic graining treatment, the method in which smut is made contact to sulfuric acid of 15 to 65 wt % at 50 to 90° C. of temperature, as described in JP 53-12739 A is preferable.

Also, when chemical etching treatment is performed in an acid solution, as acid used for the acid solution are enumerated, for example, sulfuric acid, nitric acid, hydrochloric acid but it is not limited to those.

Concentration of the acid solution is preferably 1 to 50 wt %.

In addition, temperature of the acid solution is preferably 20 to 80° C.

<Anodizing Treatment>

Anodizing treatment is performed on an aluminum plate treated as described above. With regard to the anodizing treatment, methods that have been conventionally used in this field can be used. Specifically, when direct current or alternating current is fed to the aluminum plates in aqueous solution or non aqueous solution, alone or in combination, of sulfuric acid, phosphoric acid, chromic acid, oxalic acid, sulfamic acid, benzene-sulfonic acid and the like, an anodized layer can be formed on the surface of the aluminum plate.

In this case, even if any ingredient contained in Al alloy plate, electrode, city water, underground water and the like is contained in the electrolytic solution, there is no problem. Further, containing of the second and third ingredients is also allowable. The second and third ingredients herein include ion of metal such as Na, K, Mg, Li, Ca, Ti, Al, V, Cr, Mn, Fe, Co, Ni, Cu, Zn and the like; cation such as ammonium ion; anion such as nitric acid ion, carbonic acid ion, chloride ion, phosphoric acid ion, fluoride ion, sulfurous acid ion, titanic acid ion, silicic acid ion and boric acid ion. Containing 0 to 10000 ppm of those ions is allowable.

Since conditions for anodizing treatment change variously depending on the electrolytic solution being used, those are not decided unconditionally, but it is generally appropriate that concentration of electrolytic solution is 1 to 80 wt %, temperature of solution is −5 to 70° C., current density is 0.5 to 60 A/dm$^2$, voltage is 1 to 100V, time for electrolysis is 10 to 200 seconds.

Among these anodizing treatment methods, the method in which anodizing is carried out in sulfuric acid electrolytic solution with high current density, described in UK 1,412,768 B, is particularly preferable.

In the present invention, quantity of the anodized layers is preferably 1 to 10 g/m$^2$. If it is less than 1 g/ m$^2$, plates are scratched easily. And if it is more than 10 g/m$^2$, much quantity of electricity is needed for the production, which is economically disadvantaged. Quantity of the anodized layers is preferably 1.5 to 7 g/m 2, more preferably 2 to 5 g/m$^2$.

<Treatment for Water Wettability>

In the present invention, after anodizing treatment, treatment for water wettability is performed.

Treatment for water wettability includes, for example but without limitation, includes a method for treating with alkali metal silicate described in U.S. Pat. No. 2,714,066 and U.S. Pat. No. 3,181,461, a method for treating with potassium fluorozirconate described in JP 36-22063 B, a method for treating with polyvinyl phosphonic acid described in U.S. Pat. No. 4,153,461, a method for treating with aqueous solution containing phosphoric acid and inorganic fluorine compounds described in JP 9-244227 A, and a method for treating with aqueous solution containing titanium and fluoride described in JP 10-252078 A and JP 10-263411 A. Among them, the method for treating with alkali metal silicate is preferable. In the first aspect of the present invention, the method for treating with alkali metal silicate (silicate treatment) is performed.

As the silicate treatment, various public known methods may be adopted.

Alkali metal silicate used for the silicate treatment includes, for example, sodium silicate, potassium silicate, and lithium silicate.

The silicate treatment may be performed, for example, by immersing anodized aluminum supports in alkali metal solution, in which concentration of alkali metal silicate is preferably 0.01 to 30 wt %, more preferably 0.01 to 10 wt %, further preferably 0.05 to 3 wt %, and pH at 25° C. is preferably 10 to 13, preferably at 4 to 80° C., and preferably for 0.5 to 120 seconds, more preferably 2 to 30 seconds. The conditions described above, concentration of alkali metal silicate, pH, temperature, treating time and the like may be selected as appropriate. When pH of aqueous solution of alkali metal silicate is lower than 10, the solution easily becomes gel, and when pH is higher than 13, the anodized layer is likely dissolved. These points must be paid attention.

In the treatment for water wettability, hydroxide may be compounded to keep pH of aqueous solution of alkali metal silicate high as required. As the hydroxide, for example, sodium hydroxide, potassium hydroxide and lithium hydroxide are included.

Alkaline earth metal salt and/or the group 4 (IVA) metal salt may also be formulated in the aqueous solution of alkali metal silicate. As the alkaline earth metal salt, water soluble salt such as for example, nitrate of alkaline earth metal (for example, calcium nitrate, strontium nitrate, magnesium nitrate, barium nitrate), sulfate, chloride, phosphate, acetate, oxalate, borate and the like of alkaline earth metal are included. As the group 4 (IVA) metal salt, for example, titanium tetrachloride, titanium trichloride, titanium potassium fluoride, titanium potassium oxalate, titanium sulfate, titanium tetraiodide, zirconium chloride oxide, zirconium dioxide, zirconium oxychloride, zirconium tetrachloride are included. Alkaline earth metal salt and the group 4 (IVA) metal salt may be used alone or in combination of 2 or more. The quantity of the metal salt to be used is preferably 0.01 to 10 wt %, more preferably 0.05 to 5.0 wt %.

In the present invention, quantity of alkali metal silicate adhered to the surface of the aluminum support in the silicate treatment is not limited, but in the first aspect of the present invention, as described below, ratio of the number of atoms of alkali-earth metal and silicon existing on the surface of the support for the lithographic printing plate obtained has to be within a specific range. Therefore, mass of Si atom per unit area measured by an analytical curve method using a XRF (X-ray Fluorescence Spectrometer) described below, is preferably 0.5 mg/m$^2$ or more, more preferably 1 mg/m$^2$ or more; This mass is preferably 20 mg/m$^2$ or less, more preferably 15 mg/m$^2$ or less, and particularly preferably 10 mg/m $^2$ or less.

<Washing Treatment>

In the present invention, after the treatment for water wettablity mentioned above, it is preferable to perform washing treatment using water containing 5 ppm or more of alkali-earth metal. By performing washing treatment using water containing 5 ppm or more of alkali-earth metal, it can be easily attained that ratio of the number of atom of alkali-earth metal and silicon existing on the support for the lithographic printing plate is 0.1 to 0.95 and quantity of alkali-earth metal existing on the surface of the support for the lithographic printing plate is 1 mg/m$^2$ or more. Thus press life of a lithographic printing plate is improved.

Further, as described above, even if alkali metal silicate water solution used for silicate treatment contains alkali-earth metal salt, washing treatment is needed, and when ordinary washing treatment, that is, washing treatment using water containing no alkali-earth metal is performed, alkali-earth metal is removed by salt exchange. Therefore, there is no effect to improve press life of a lithographic printing plate by making alkali metal silicate water solution used for silicate treatment contain alkali-earth metal salt.

Water (washing water) used for washing treatment is not limited if it contains 5 ppm or more of alkali-earth metal. In the present invention, well water or industrial water and the like, in which alkali-earth metal is added thereto so as to be the concentration of 5 ppm or more, may be used as washing water, or well water or industrial water and the like, in which 5 ppm or more of alkali-earth metal is contained from the beginning, may be also used.

Concentration of alkali-earth metal in the washing water is preferably 10 ppm or more, more preferably 15 ppm or more. Also, upper limit of the concentration of alkali-earth metal in the washing water is not limited, and may be decided properly in consideration for the application, production cost of a lithographic printing plate and the like.

Further the washing water may contain other ingredients in the scope that does not damage objects of the present invention.

Temperature of the washing water is not particularly limited and it may be decided properly in accordance with the concentration of alkali-earth metal in the washing water and the like.

The method of washing treatment is not limited, and for example enumerated are a spraying method and a dipping method. These may be used independently one time or multiple times, or may be used in combination of 2 or more. Time of washing treatment is not limited, and it may be decided properly in accordance with the concentration of alkali-earth metal of the washing water and the like.

A support for a lithographic printing plate according to the first aspect of the present invention obtained in the above described manner is characterized by that ratio of the number of atoms of alkali-earth metal and silicon existing on its surface is 0.1 to 0.95. Namely in the first aspect of the present invention, it is characterized that alkali-earth metal exists on the surface of a support for a lithographic printing plate, and in addition, a ratio of the number of atoms of alkali-earth metal to those of silicon which is caused by silicate treatment is 0.1 to 0.95.

In short, in the first aspect of the present invention, the support for the lithographic printing plate being excellent either in development performance (scum resistance) of the presensitized plate and in press life of the lithographic printing plate is materialized by making alkali-earth metal exist on the surface of the support for the lithographic printing plate and, in addition, making ratio of the number of atoms of alkali-earth metal and silicon be within the range mentioned above.

The alkali-earth metal used in the present invention is not limited. The alkali-earth metal may be used singularly, or may be used in combination of two kinds or more. Among the alkali-earth metal, Ca and Mg are preferable, and particularly Ca is preferable.

Further in the present specification, in the case of using two kinds or more of alkali-earth metal, as each value of the alkali-earth metal (atom number, content, existing amount and the like); the sum of the value of each alkali-earth metal is applied.

The ratio of the number of atoms (M/Si) of alkali-earth metal (M) to those of silicon (Si) should be 0.1 or more, preferably 0.2 or more, from a viewpoint of press life.

In addition, the ratio of the number of atoms of alkali-earth metal to those of silicon should be 0.95 or less, preferably 0.9 or less, from a viewpoint of scum resistance.

Further, in the first aspect of the present invention, amount of alkali-earth metal existing on the surface of the support for the lithographic printing plate is not limited but the ratio of the number of atoms of alkali-earth metal to those of silicon is needed to be within a specific range. Therefore, mass of alkali-earth metal existing per the unit area is preferably 1 $mg/m^2$ or more.

Also, the support for the lithographic printing plate according to the second aspect of the present invention is characterized by that 1 $mg/m^2$ or more of alkali-earth metal exists on its surface.

In short, in the second aspect of the present invention, the support for the lithographic printing plate having excellent press life of the lithographic printing plate is materialized by making a specific amount of alkali-earth metal exist on the surface of the support for the lithographic printing plate.

In the present invention, the support for the lithographic printing plate satisfying both of the first aspect and the second aspect is preferable. Namely, the support for the lithographic printing plate obtained by performing anodizing treatment and silicate treatment on the aluminum plate, in which 1 $mg/m^2$ or more of alkali-earth metal exists on its surface and in addition, the ratio of the number of atoms of alkali-earth metal to those of silicon existing on the surface is 0.1 to 0.95, is preferable. Also the support for the lithographic printing plate mentioned above, on which washing treatment using water containing 5 ppm or more of alkali-earth metal is performed after silicate treatment mentioned above, is more preferable.

In the first and second aspects of the present invention, a method to make alkali-earth metal exist on the surface includes suitably a way of washing treatment using water containing 5 ppm or more of alkali-earth metal mentioned above, but other ways may be used. For example, in a case of washing using ordinary water after treatment for water wettablity, it is acceptable that alkali-earth metal is allowed to exist on the surface of the support for the lithographic printing plate by forming a photosensitive layer or an undercoat layer containing alkali-earth metal on the surface of a support for a lithographic printing plate. The presensitized plate obtained in this way is one of the suitable aspects of the present invention.

For details of each treatment described in each of the above items, well-known conditions can be employed suitably. Also, the contents of literatures cited herein are incorporated herein by reference.

In order to process the support for the lithographic printing plate of the invention into a presensitized plate, sensitizers can be applied to its surface and dried to form the photosensitive layer. The sensitizers that can be used are in no way limited and any types may be applied that are commonly used on presensitized plates.

For example, a conventional positive working type photosensitive layer containing a novolac resin and a naphthoquinone diazide is enumerated.

The thus presensitized plate is exposed imagewise with a lith film and subsequently developed and gummed to prepare a lithographic printing plate that can be mounted on the press.

Further, forming of a photosensitive layer formed of a material having sensitivity to a laser, makes it possible to exposure an image directly to a presensitized plate using the laser. For example, a thermal positive working type of a photosensitive layer and a thermal negative working type of a photosensitive layer are enumerated. Concretely, a photosensitive layer containing an infrared absorbent, a compound of generating acid by heat and a compound of being cross-linked by an acid; a photosensitive layer containing an infrared absorbent, a compound of generating acid by heat and a compound having a bond to be broken down by an acid; a photosensitive layer containing two layers includes a layer containing a compound of generating a radical by laser beam irradiation, a binder soluble in an alkali and a polyfunctional monomer or pre-polymer and an oxygen barrier layer; a photosensitive layer containing two layers composed of a physical development nuclei layer and a silver halide emulsion layer; a photosensitive layer containing three layers of a polymerizable layer composed of a polyfunctional monomer and a polyfunctional binder, a layer composed of a silver halide and a reducing agent and an oxygen barrier layer; a photosensitive layer containing two layers includes a layer containing a novolac resin and a naphthoquinone diazide and a layer containing a silver halide; a photosensitive layer containing an organic photoconductive material; a photosensitive layer composed of a laser absorbent layer which is removed by laser beam radiation and a ink-receptivity layer and/or a water receptive layer; a photosensitive layer containing a compound of generating acid by absorbing energy, a high-molecular compound having functional groups in the side chains which generates sulfonic acid or a carbonic acid by acid, and a compound giving energy to an acid generator by absorbing visible ray, are enumerated.

A thermal positive working type photosensitive layer contains (A) resin insoluble in water and soluble in alkali (hereunder it is referred as an alkali-soluble high-molecular compound) and (B) a photothermal conversion material. Hereunder such thermal positive working type photosensitive layers will be described in the concrete.

(A) Alkali-Soluble High-Molecular Compound

An alkali-soluble high-molecular compound used in the present invention is not limited as long as it is high-molecular compound which is insoluble in water and soluble in alkali water solution. For example a public known and widely used novolac resin, phenol modified xylene resin, polyhydroxy styrene, polyhydroxy styrene halide, such acrylic resin having phenolic hydroxy group as described in JP 51-34711 A, acrylic resin having sulfonamide group described in JP 2-866 A and an urethane-type resin, are enumerated.

As a novolac resin, for example phenol formaldehyde resin, m-cresol formaldehyde resin, p-cresol formaldehyde resin, o-cresol formaldehyde resin, m-/p-mixed cresol formaldehyde resin, phenol/cresol (any one of m-, p-, o-, m-/p-mixed, m-/o-mixed and o-/p-mixed is acceptable) mixed formaldehyde resin, are included. Weight-average molecular weight of the novolac resin is preferably about 12,000 or less.

As a urethane-type resin, for example those described in JP 63-124047 A, JP 63-261350 A, JP 63-287942 A, JP 63-287943 A, JP 63-287944 A, JP 63-287946 A, JP 63-287947 A, JP 63-287948 A, JP 63-287949 A, JP 1-134354 A and JP 1-255854 A are preferably included.

In the present invention, an alkali-soluble high-molecular compound is preferably a high-molecular compound having any functional group of (1) a phenolic hydroxy group (2) a sulfonamide group (—$SO_2$NH—R) and (3) a substituted sulfonamide-type acid group (—$SO_2$NHCOR, —$SO_2$NH$SO_2$R, —CONH$SO_2$R)(hereinafter they are referred as "active imide group") within its molecule.

(1) As a high-molecular compound having phenolic hydroxy group, a high-molecular compound having a phenolic hydroxy group in a side chain is preferably used. As a high-molecular compound having a phenolic hydroxy group in a side chain, high-molecular compounds which are obtained by homopolymerizing a polymerizable monomer composed of a low molecular compound having one or more each of phenolic hydroxy group and polymerizable unsaturated bonding or by co-polymerizing the monomer with other polymerizable monomers, are mentioned.

As a polymerizable monomer having a phenolic hydroxy group, for example, acrylamide, methacrylamide, ester acrylic, methacrylic ester having a phenolic hydroxy group, hydroxy styrene are enumerated. In the concrete, N-(2-hydroxyphenyl)acrylamide, N-(3-hydroxyphenyl) acrylamide, N-(4-hydroxyphenyl) acrylamide, N-(2-hydroxyphenyl)methacrylamide, N-(3-hydroxyphenyl) methacrylamide, N-(4-hydroxyphenyl)methacrylamide, o-hydroxyphenyl acrylate, m-hydroxyphenyl acrylate, p-hydroxyphenyl acrylate, o-hydroxyphenyl methacrylate, m-hydroxyphenyl methacrylate, p-hydroxyphenyl methacrylate, o-hydroxystyrene, m-hydroxystyrene, p-hydroxystyrene, 2-(2-hydroxyphenyl)ethyl acrylate, 2-(3-hydroxyphenyl)ethyl acrylate, 2-(4-hydroxyphenyl)ethyl acrylate, 2-(2-hydroxyphenyl)ethyl methacrylate, 2-(3-hydrxyphenyl)ethyl methacrylate, 2-(4-hydroxyphenyl) ethyl methacrylate and the like are preferably used.

Such a high-molecular compound having a phenolic hydroxy group may be used in the combination of two kinds or more.

In addition, as described in U.S. Pat. No. 4,123,279, such a condensation polymer of phenol having, as a substituted group, alkyl group with 3 to 8 of carbon atom and formaldehyde, such as t-butylphenol formaldehyde resin or octylphenol formaldehyde resin, may be used together.

(2) As an alkali-soluble high-molecular compound having a sulfonamide group, for example, a high-molecular compound obtained by homopolymerizing a polymerizable monomer having sulfonamide group or by co-polymerizing the monomer with other polymerizable monomers is mentioned. As a polymerizable monomer having a sulfonamide group, for example, a polymerizable monomer composed of low molecular weight compound having one or more each of sulfonamide group —NH—$SO^2$— in which at least one hydrogen atom is bonded on a nitrogen atom and polymerizable unsaturated bonding in per molecule is mentioned. Among them a low molecular weight compound having an acryloyl group, an allyl group or a vinyloxy group, and mono-substituted aminosulfonyl group or a substituted sulfonyl imino group is preferable. As these compounds, for example, compounds indicated in general formulae (I) to (V) shown below are enumerated.

(I)

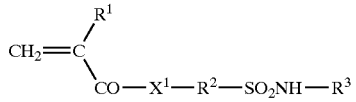

(II)

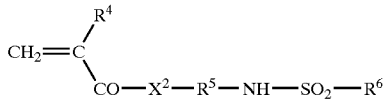

(III)

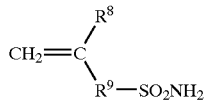

(IV)

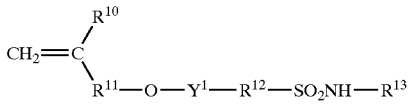

(V)

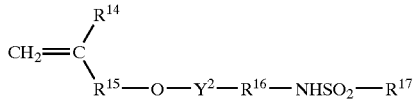

In the formulae, each of $X^1$and $X^2$ indicates —O— or —$NR_7$—. Each of $R^1$and $R^4$ indicates hydrogen atom or —$CH_3$. Each of $R^2$, $R^5$, $R^9$, $R^{12}$and $R^{16}$ indicates an alkylene group, a cycloalkylene group, an arylene group or an aralkylene group, each of which may have substituents and have 1 to 12 of carbon atom. Each of $R^3$, $R^7$ and $R^{13}$ indicates a hydrogen atom or an alkyl group, a cycloalkyl group, an aryl group or an aralkyl group, each of which may have substituents and have 1 to 12 of carbon atom. Further, each of $R^6$ and $R^{17}$ indicates an alkyl group, a cycloalkyl group, an aryl group or anarakyl group, each of which may have substituents and have 1 to 12 of carbon atom. Each of $R^8$, $R^{10}$ and $R^{14}$ indicates a hydrogen atom or —$CH^3$. Each of $R^{11}$ and $R^{15}$ indicates single bond or an alkylene group, a cycloalkylene group, an arylene group or an aralkylene group, each of which may have substituents groups and have 1 to 12 of carbon atom. Each of $Y^1$ and $y^2$ indicates single bond or —CO—. Specifically, m-aminosulfonylphenyl methacrylate, N-(p-aminosulfonylphenyl)methacrylamide, N-(p-aminosulfonylphenyl)acrylamide, or the like, may be preferably used.

(3) An alkali-soluble high-molecular compound having an active imide group is preferably one having the active imide group within the molecule as indicated in the formula shown below. As the high-molecular compound, a high-molecular compound obtained by homopolymerizing a polymerizable monomer composed of a low molecular weight compound having one or more each of an active imide group shown in the formula indicated below and a polymerizable unsaturated bond or by co-polymerizing the monomer with other polymerizable monomers, is mentioned.

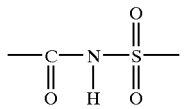

As these compounds, concretely, N-(p-toluenesulfonyl) methacrylamide, N-(p-toluenesulfonyl)acrylamide or the like may be preferably used.

In addition, as an alkali-soluble high-molecular compound used in the present invention, a high molecular compound obtained by polymerizing two kinds or more among the polymerizable monomer having a phenolic hydroxy group, the polymerizable monomer having a sulfonamide group and the polymerizable monomer having an active imide group or obtained by co-polymerizing two kinds or more of these polymerizable monomers with other polymerizable monomers, is preferably mentioned.

In the case of co-polymerizing the poymerizable monomer having the phenolic hydroxy group with the polymerizable monomer having the sulfonamide group and/or the polymerizable monomer having the active imide group, compounding ratio of mass of these components is preferably in the range of 50:50 to 5:95 more preferably in the range of 40:60 to 10:90.

When an alkali-soluble high-molecular compound is a copolymer between such monomers which provide alkali soluble property as a polymerizable monomer having the phenolic hydroxy group, a polymerizable monomer having sufonylamide group, a polymerizable monomer having the active imide group and the like and other polymerizable monomers, it preferably contains 10 mol % or more of monomers which provides alkali soluble property, more preferably contains 20 mol % or more. When the copolymer component is 10 mol % or less, alkali soluble property becomes insufficient easily and improvement effect of development latitude can not be attained sufficiently sometimes.

As a monomer component to be co-polymerized with a polymerizable monomer having the phenolic hydroxy group, a polymerizable monomer having the sulfonylamide group or a polymerizable monomer having the active imide mentioned above, for example, monomers enumerated in (1) to (12) shown below may be used but not limited to these.

(1) Acrylic esters and methacrylic esters having an aliphatic hydroxy group such as 2-hydroxyethyl acrylate, 2-hydroxyethyl methacrylate and the like.

(2) Alkyl acrylates such as methyl acrylate, ethyl acrylate, propyl acrylate, butyl acrylate, amyl acrylate, hexyl acrylate, octyl acrylate, benzyl acrylate, 2-chloroethyl acrylate, glycidyl acrylate, N-dimethylaminoethyl acrylate and the like.

(3) Alkyl methacrylates such as methyl methacrylate, ethyl methacrylate, propyl methacrylate, butyl mehtacrylate, amyl methacrylate, hexyl methacrylate, cyclohexyl methacrylate, benzyl methacrylate, 2-chloroethyl methacrylate, glycidyl methacrylate, N-dimethyl aminoethyl methacrylate and the like.

(4) Acrylamides and methacrylamides such as acrylamide, methacrylamide, N-methylolacrylamide, N-ethylacrylamide, N-hexylmethacrylamide, N-cyclohexylacrylamide, N-hydroxyethylacrylamide, N-phenylacrylamide, N-nitrophenylacrylamide, N-ethyl-N-phenylacrylamide and the like.

(5) Vinyl ethers such as ethyl vinyl ether, 2-chloroethyl vinyl ether, hydroxyethyl vinyl ether, propyl vinyl ether, butyl vinyl ether, octyl vinyl ether, phenyl vinyl ether and the like.

(6) Vinyl esters such as vinyl acetate, vinyl chloroacetate, vinyl butyate, vinyl benzoate and the like.

(7) Styrenes such as styrene, α-methylstyrene, methylstyrene, chloromethylstyrene and the like.

(8) Vinylketones such as methyl vinylketone, ethyl vinylketone, propyl vinylketone, phenyl vinylketone and the like.

(9) Olefins such as ethylene, propylene, isobutylene, butadiene, isoprene and the like.

(10) N-vinylpyrrolidone, N-vinylcarbazole, 4-vinylpyridine, acrylonitrile, methacrylonitrile and the like.

(11) Unsaturated imides such as maleimide, N-acryloyl acrylamide, N-acetylmethacrylamide, N-propionyl methacrylamide, N-(p-chlorobenzoyl)methacrylamide and the like.

(12) Unsaturated carbonic acids such as acrylic acid, methacrylic acid, maleic anhydride, itaconic acid and the like.

In the present invention, when an alkali-soluble high-molecular compound is a homopolymer or a co-polymer of a polymerizable monomer having the phenolic hydroxy group, a polymerizable monomer having a sulfonamide group or the polymerizable monomer having the active imide group mentioned above, preferably weight-average molecular weight of the high-molecular compound is 2,000 or more and number-average molecular weight is 500 or more. More preferably, the weight-average molecular weight is 5,000 to 300,000 and the number-average molecular weight is 800 to 250,000 and degree of dispersion (weight-average molecular weight/number-average molecular weight) is 1.1 to 10.

These alkali-soluble high-molecular compound may be used independently or may be used in combination of two kinds or more and the content of the alkali-soluble high-molecular compound is preferably 30 to 99 wt % to total solid content in a photosensitive layer, more preferably 40 to 95 wt %, particularly preferably 50 to 90 wt %. When the content of alkali-soluble high-molecular compound is less than 30 wt %, durability of the photosensitive layer is deteriorated. When the content is more than 99 wt %, both of sensitivity and durability are not preferable.

(B) Photothermal Conversion Material

A photothermal conversion material used in the present invention is a material, which absorbs light and generates heat. The photothermal conversion material makes it possible to convert exposure energy to heat and to release mutual actions in exposure areas of the photosensitive layer effectively.

In the present invention, the photosensitive conversion material is not particularly limited as long as it has a function of absorbing light used for recording and converting the light to heat. However, from a viewpoint of recording sensitivity a pigment or a dye having light-absorbing range in infrared range of 700 to 1200 nm of wavelength is preferable.

As the pigment, commercially available pigments or pigments described in "Color Index (C. I.) Handbook", "Latest Pigment Handbook (Saishin Ganryo Binran)" (edited by Japan Association of Pigment Technology, 1977), "Latest Pigment Application Technology (Saishin Ganryo Oyo Gijyutsu)" (CMC, 1986) and "Printing Ink Technology (Insatsu Inki Gijyutsu)" (CMC, 1984) can be used.

Examples of the above-described pigments include a black pigment, an yellow pigment, an orange pigment, a brown pigment, a red pigment, a purple pigment, a blue pigment, a green pigment, a fluorescent pigment, a metal powder pigment and a polymer-bonded dyestuff. Specific examples of the pigments include an insoluble azo pigment, an azo lake pigment, a condensed azo pigment, a chelate azo pigment, a phthalocyanine-based pigment, an anthraquinone-based pigment, a perylene and perinone-based pigment, a thioindigo-based pigment, a quinacridone-based pigment, a dioxazine-based pigment, an isoindolinone-based pigment, a quinophthalone-based pigment, a dyeing lake pigment, an azine pigment, a nitroso pigment, a nitro pigment, a natural pigment, an inorganic pigment and a carbon black.

These pigments may be used without surface treatment or may be used after the surface treatment. Surface treatment methods include a surface coating method with resin and wax, a method of adhering surfactant, a method of bonding a reactive substance (for example, a silane coupling agent, an epoxy compound and polyisocyanate) to a pigment surface. The above-described surface treatment methods are described in "Properties and Applications of Metal Soaps" (Saiwai Shobo Co., Ltd.), "Printing Ink Technology (Insatsu Inki Gijyutsu)" (CMC, 1984) and "Latest Pigment Application Technology (Saishin Ganryo Oyo Gijyutsu)" (CMC, 1986).

A particle diameter of the above-described pigments preferably ranges from 0.01 to 10 $\mu$m, more preferably from 0.05 to 1 $\mu$m, much more preferably from 0.1 to 1 $\mu$m. It is not preferable that the particle diameter of the pigments be less than 0.01 $\mu$m in terms of stability of the dispersant in the photosensitive layer coating liquid. And, it is not preferable that the particle diameter exceeds 10 um in terms of evenness of the photosensitive layer.

As a method of dispersing the above-described pigments, a well-known dispersing technology for use in preparing ink, toner and the like can be used. Examples of the dispersing machine include an ultrasonic dispersing machine, a sandmill, an atritor, a pearl mill, a super mill, a ball mill, an impeller, a disperser, a KD mill, a colloid mill, a dynatron, a three-roll mill and a pressurizing kneader. Details thereof are described in "Latest Pigment Application Technology (Saishin Ganryo Oyo Gijyutsu)" (CMC, 1986).

As the above-described dyes, commercially available dyes and well-known dyes described in documents (for example, "Dye Handbook" edited by The Society of Synthetic Organic Chemistry, Japan, 1970) can be used. Specific examples of the dyes include an azo dye, an azo dye in the form of a metallic complex salt, a pyrazolone azo dye, a naphthoquinone dye, an anthraquinone dye, a phthalocyanine dye, a carbonium dye, a quinoneimine dye, a methyne dye, a cyanine dye, a squarylium dyestuff, a pyrylium salt and a metal thiolate complex (for example, nickel thiolate complex).

In the present invention, among the above-described pigments and dyes, the ones absorbing infrared rays or near-infrared rays are particularly preferable in that they are suitable for use in a laser emitting the infrared rays or near-infrared rays.

As such pigments absorbing the infrared rays or near-infrared rays, carbon black is preferably used. Moreover, examples of the dyes absorbing the infrared rays or near-infrared rays include the cyanine dye described in JP 58-125246 A, JP 59-84356 A, JP 59-202829 A, JP 60-78787 A and the like, the methyne dye described in JP 58-173696 A, JP 58-181690 A, JP 58-194595 A and the like, the naphthoquinone dye described in JP 58-112793 A, JP 58-224793 A, JP 59-48187 A, JP 59-73996 A, JP 60-52940 A, JP 60-63744 A and the like, the squarylium dyestuff described in JP 58-112792 A and the like, the cyanine dye described in UK 434,875 B and the dihydroperimidine squarylium described in U.S. Pat. No. 5,380,635.

Moreover, as the above-described dye, the near-infrared ray absorbing sensitizer described in U.S. Pat. No. 5,156,938 is also preferably used. Furthermore, more preferably used are the substituted aryl benzo(thio)pyrylium salt described in U.S. Pat. No. 3,881,924, the trimethyne thiopyrylium salt described in JP 57-142645 A (U.S. Pat. No. 4,327,169), the pyrylium series compound described in JP 58-181051 A, JP 58-220143 A, JP 59-41363 A, JP 59-84248 A, JP 59-84249 A, JP 59-146063 A and JP 59-146061 A, the cyanine dyestuff described in JP 59-216146 A, the pentamethyne thiopyrylium salt and the like described in U.S. Pat. No. 4,283,475, the pyrylium compound described in JP 5-13514 B and JP 5-19702 B; Epolight III-178, Epolight III-130, Epolight III-125, Epolight IV-62A (these are all made by Epolin Co.) and the like.

Moreover, as another example of the above-described more preferable dyes, the near-infrared ray absorbing dye represented in the formula (I) or (II) in U.S. Pat. No. 4,756,993 is enumerated.

Content of these pigments or dyes is preferably in the range of 0.01 to 50 wt % to total solid content in the photosensitive layer, more preferably in the range of 0.01 to 30 wt %, further more preferably in the range of 0.1 to 10 wt %. In the case of dye, the amount ranges particularly preferably from 0.5 to 10 wt %. In the case of pigments, the amount ranges particularly preferably from 1.0 to 10 wt %. When an additional amount of the pigment or dye is less than 0.01 wt %, the photosensitivity is lowered. When the additional amount exceeds 50 wt %, the evenness of the photosensitive layer is lost, and the durability of the photosensitive layer is deteriorated.

Each of these pigments or dyes may be added into the same layer as that having other components. Alternatively, another layer may be provided, and each of these pigments or dyes may be added thereinto. In the case where another layer is provided, preferably, another layer is provided to be adjacent to the layer containing the substance of the present invention, which has thermal decomposability and substantially lowers the solubility of the alkali-soluble high-molecular compound in an undecomposed state, and the pigment or dye is added thereinto.

A thermal positive working type photosensitive layer may, in addition, contain various kinds of additives, according to needs. For example, when a preferable material, which is heat decomposable and lowers solubility of an alkali-soluble high-molecular compound substantially in the state of non decomposition, is used together, preventive dissolving properties of image areas into developer may be improved. As such a material, for example, an onium salt, a quinon diazide, an aromatic sulfonic compound, an aromatic sulfonic ester compound, are enumerated.

As an onium salt, for example, a diazonium salt, an ammonium salt, a phosphonium salt, an iodonium salt, a sulfonium salt, a selenonium salt, an arsonium salt, are enumerated.

As preferable ones among them, for example, a diazonium salt described in S. I. Schlesinger, Photogr, Sci. Eng., 18,387 (1974), T. S. Bal et al, Polymer, 21, 423 (1980) and JP 5-158230 A, an ammonium salt described in U.S. Pat. No. 4,069,055, U.S. Pat. No. 4,069,056 and JP 3-140140 A, a phosphonium salt described in D.C. Necker et al, Macromolecules, 17, 2468 (1984), C. S. Wen et al, Teh, Proc. Conf. Rad. Curing ASIA, p. 478, Tokyo, Oct (1988), U.S. Pat. No. 4,069,055 and U.S. Pat. No. 4,069,056, an iodonium salt described in J. V. Crivello et al, Macromorecules, 10 (6), 1307 (1977), Chem. & amp, Eng. News, Nov. 28, p. 31 (1988), EP 104,143 B, U.S. Pat. No. 339,049, U.S. Pat. No. 410,201, JP 2-150848 A and JP 2-296514 A, a sulfonium salt described in J. V. Crivello et al, Polymer J. 17, 73 (1985), J. V. Crivello et al. J. Org. Chem., 43, 3055 (1978), W. R. Watt et al, J.Polymer Sci., Polymer Chem. Ed., 22, 1789 (1984), J. V. Crivello et al, Polymer Bull., 14, 279(1985), J. V. Crivello et al, Macromorecules, 14 (5), 1141 (1981), J. V. Crivello et al, J.Polymer Sci., Polymer Chem. Ed., 17, 2877 (1979), EU 370,693 B, EU 233,567 B, EU 297,443 B, EU 297,442 B, U.S. Pat. No. 4,933,377, U.S. Pat. No. 3,902,114, U.S. Pat. No. 410,201, U.S. Pat. No. 339,049, U.S. Pat. No. 4,760,013, U.S. Pat. No. 4,734,444, U.S. Pat. No. 2,833,827, DE 2,904,626 B, DE 3,604,580 B and DE 3,604,581 B, a selenonium salt described in J. V. Crivello et al, Macromorecules, 10 (6), 1307 (1977) and J. V. Crivello et al, J. Polymer Sci., Polymer Chem. Ed., 17, 1047 (1979), an arsonium salt described in C. S. Wen et al, Teh, Proc. Conf. Rad. Curing ASIA, p.478, Tokyo, Oct (1988), are enumerated.

As a counter ion of the onium salt, for example, tetrafluoroboric acid, hexafluorophosphoric acid, triisopropylnaphthalene sulfonic acid, 5-nitro-o-toluene sulfonic acid, 5-sulfosalicilic acid, 2,5-dimethylbenzen sulfonic acid, 2,4,6-trimethylbenzen sulfonic acid, 2-nitrobenzen sulfonic acid, 3-chlorobenzen sulfonic acid, 3-bromobenzen sulfonic acid, 2-fluorocaprylnaphtalene sulfonic acid, dodecylbenzen sulfonic acid, 1-naphthol-5-sulfonic acid, 2-methoxy-4-hydroxy-5-bezoil-benzen sulfonic acid, paratoluenesulfonic acid, are enumerated. Among them, hexafluorophosphoric acid or an alkyl aromatic sulfonic acid such as triisopropylnaphthalene sulfonic acid, 2,5-dimethylbenzen sulfonic acid and the like is preferable.

Content of the onium salt is preferably in the range of 1 to 50 wt % to total solid content in the photosensitive layer, more preferably in the range of 5 to 30 wt %, further more preferably in the range of 10 to 30 wt %.

In the present invention, additives and binders are preferably contained in the same layer.

The photosensitive layer may contain cyclic acid anhydrides, phenols, and organic acids for the purpose of increasing the photosensitivity.

Examples of the cyclic acid anhydrides include phthalic anhydride, tetrahydrophthalic anhydride, hexahydrophthalic anhydride, 3,6-endoxy-Δ4-tetrahydrophthalic anhydride, tetrachlorophthalic anhydride, maleic anhydride, chloromaleic anhydride, α-phenylmaleic anhydride, succinic anhydride and pyromellitic anhydride, which are described in U.S. Pat. No. 4,115,128.

Examples of the phenols include bisphenol A, p-nitrophenol, p-ethoxyphenol, 2,4,4'-trihydroxy benzophenone, 2,3,4-trihydroxy benzophenone, 4-hydroxy benzopenone, 4,4',4"-trihydroxy triphenylmethane, 4,4',3",4"-tetrahydroxy-3,5,3',5'-tetramethyl triphenylmethane.

Examples of the organic acids include sulfonic acids, sulfinic acids, alkyl sulfuric acids, phosphonic acids, phosphoric esters and carboxylic acids, which are describe in the gazettes of JP 60-88942 A and JP 2-96755 A. Specific examples include p-toluenesulfonic acid, dodecylbenzenesulfonic acid, p-toluenesulfinic acid, ethylsulfuric acid, phenylphosphonic acid, phenylphosphinic acid, phenyl phosphate, diphenyl phosphate, benzoic acid, isophthalic acid, adipic acid, p-toluic acid, 3,4-dimethoxy benzoic acid, phthalic acid, terephtalic acid, 4-cyclohexene-1,2-dicarboxylic acid, erucic acid, lauric acid, n-undecanoic acid, ascorbic acid.

Amounts of the foregoing cyclic acid anhydride, phenols and organic acids in the total solids of the layer in which they are contained preferably ranges from 0.05 to 20 wt %, more preferably from 0.1 to 15 wt %, particularly preferably from 0.1 to 10 wt %.

Further, the photosensitive layer may contain a nonionic surface active agent described in JP 62-251740 A and JP 3-208514 A, an ampholytic surface active agent described in JP 59-121044 A and JP 4-13149 A, a siloxane-type compound described in EU 950,517 A, a copolymer of monomers containing fluorine described in JP 11-288093 A in order to widen stability of treatment for variation of development conditions.

Concrete examples of the above-described nonionic surfactant include sorbitan tristearate, sorbitan monopalmitate, sorbitan triolate, stearic acid monoglyceride and polyoxyethylene nonylphenyl ether.

Concrete examples of the above-described amphoteric surfactant include alkyldi(aminoethyl)glycin, alkyl polyaminoethyl glycin hydrochloride, 2-alkyl-N-carboxyethyl-N-hydroxyethylimidazolinium betaine and N-tetradecyl-N,N-betaine type (for example, article name "Amogen K", made by Dai-ichi Kogyo Co., Ltd.).

The content of each of the foregoing nonionic surfactant and the amphoteric surfactant in the total solids of the layer in which they are contained preferably ranges from 0.05 to 15 wt %, more preferably 0.1 to 5 wt %.

Further, the photosensitive layer may contain a printing out agent for obtaining a visible image immediately after heating by exposure, as well as the dye or the pigment as an image coloring agent.

As printing out agent, combination of a compound releasing acid by heating by exposure (photo-acid releasing agent) and an organic dye capable of forming salt is exemplified. Specifically, enumerated are combination of o-naphthoquinone diazide-4-sulfonic acid halogenide and salt-forming organic dye, which are described in JP 50-36209 A and JP 53-8128 A and combination of a trihalomethyl compound and a salt-forming organic dye, which are described in JP 53-36223 A, JP 54-74728 A, JP 60-3626 A, JP 61-143748 A, JP 61-151644 A and JP 63-58440 A. As such trihalomethyl compound, there are an oxazole series compound and a triazine series compound, both of which exhibit storability, and produce a clear printed out image.

As image coloring agent, dyes other than the above-described salt-forming organic dye can be used. As preferable dyes, an oil soluble dye and a basic dye including the salt-forming organic dye can be cited. Specific examples include oil yellow #101, oil yellow #103, oil pink #312, oil green BG, oil blue BOS, oil blue #603, oil black BY, oil black BS, and oil black T-505 (these are all made by Orient Chemical Industries Ltd.), Victorian pure blue, crystal violet (C. I. 42555), methyl violet (C. I. 42535), ethyl violet, Rhodamine B (C. I. 145170B), malachite green (C. I. 42000) and methylene blue (C. I. 52015). Particularly preferable dyes are those described in JP 62-293247 A and JP 5-313359 A.

The content of the above dyes in the total solids of the layer in which they are contained preferably ranges from 0.05 to 15 wt %, more preferably 0.1 to 5 wt %.

Further, the photosensitive layer may contain a plasticizer for the purpose of providing a coating layer with flexibility and the like. Examples include butyl phthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and acrylic or methacrylic acid oligomer or polymer.

EXAMPLES

The following examples are provided for the purpose of further illustrating the present invention but are in no way to be taken as limiting.

1. Preparation of Presensitized Plates

Example 1 to 3 and Comparative Example 1 and 2

Molten metal was prepared by using an aluminum alloy containing Si: 0.06 wt %, Fe: 0.30 wt %, Cu: 0.005 wt %, Mn: 0.001 wt %, Mg: 0.001 wt %, Zn: 0.001 wt % and Ti: 0.03 wt %, and containing Al and inevitable impurities for the remaining portion. After molten metal processing and filtering, an ingot having a thickness of 500 mm and a width of 1200 mm was made by a DC casting method. After the surface was chipped to have an average thickness of 10 mm by a surface chipper, the ingot was held at 550° C. for about 5 hours for soaking. When the temperature dropped to 400° C., the ingot was formed into a rolled plate having a thickness of 2.7 mm by using a hot rolling mill. Further, after the heat treatment carried out at 500° C. by using a continuous annealing machine, the rolled plate was finished into an aluminum plate having a thickness of 0.24 mm by cold rolling. This aluminum plate was processed to have a width of 1030 mm, and surface treatment described below was continuously carried out.

(a) Alkali Etching

The aluminum plate obtained in the foregoing manner was subjected to spray etching by using aqueous solution containing 2.6 wt % of sodium hydroxide and 6.5 wt % of aluminum ions at a temperature of 70° C., and the aluminum plate was dissolved by 6 g/m$^2$. Then, the aluminum plate was washed by water spraying.

(b) Desmutting

The aluminum plate was subjected to spray desmutting treatment in aqueous solution of nitric acid 1 wt % (containing 0.5 wt % of aluminum ions), and then washed by water spraying. For the aqueous solution of nitric acid used in the desmutting treatment, waste solution generated in the process of electrochemical graining carried out by using an alternating current in the aqueous solution of nitric acid was utilized.

(c) Electrochemical Graining

Electrochemical graining treatment was continuously carried out by using an AC voltage of 60 Hz. Electrolytic solution in this case was the aqueous solution of nitric acid 10.5 g/L (containing aluminum ions 5 g/L and ammonium ions 0.007 wt %), and the temperature was 50° C. By using an AC power supply whose waveform was a trapezoidal wave with the time TP necessary for a current value to reach its peak from zero set at 0.8 msec, and duty ratio set at 1:1, the electrochemical graining treatment was carried out while carbon electrodes were set as counter electrodes. Ferrite was used for an auxiliary anode. Two electrolytic cells were used.

A current density was 30 A/dm$^2$ at a current peak value. Regarding the quantity of electricity, the total of the quantity of electricity was 220 C/dm$^2$ when the aluminum plate was at the anode side. An amount equivalent to 5% of a current flowing from a power source was diverted to the auxiliary anode.

Then, the aluminum plate was washed by water spraying.

(d) Alkali Etching

The aluminum plate was subjected to spray etching by using aqueous solution containing 26 wt % of sodium hydroxide and 6.5 wt % of aluminum ions at a temperature of 32° C. The aluminum plate was dissolved by 0.20 g/m$^2$, a smut component mainly containing aluminum hydroxide generated in the previous stage of the electrochemical graining carried out by using the alternating current was removed, and the edge portion of a formed pit was dissolved to be made smooth. Then, the aluminum plate was washed by water spraying.

(e) Desmutting

The aluminum plate was subjected to spray desmutting in aqueous solution of sulfuric acid 25 wt % (containing 0.5 wt % of aluminum ions) at a temperature of 60° C. Then, the aluminum plate was washed by water spraying.

(f) Anodizing

By using the anodizing device (each of first and second electrolytic portions has a length of 6 m, each of first and second power supply units has a length of 3 m, and each of first and second power supply electrodes has a length of 2.4 m) of a two-stage power supply electrolytic method, anodizing was carried out. Electrolytic solution supplied to each of the first and second electrolytic portions was sulfuric acid. Concentration of sulfuric acid for each of electrolytic portions was 50 g/L (containing aluminum ions 0.5 wt %), and the temperature was 20° C. Then, the aluminum plate was washed by water spraying. The amount of oxide layer was 2.7 g/m$^2$ at the end.

(g) Silicate Treatment

An aluminum support obtained by performing anodizing treatment was dipped in sodium silicate solution with 1.1 wt % of concentration and 30 Cof temperature for 10 seconds for silicate treatment, and after that the aluminum support was washed by spraying using any one of washing water 1 to shown in Table 1 to obtain supports for lithographic printing plates 1 to 5.

TABLE 1

| No. | Washing water | Ca content (ppm) |
|---|---|---|
| 1 | Well water | 25 |
| 2 | Calcium chloride solution with concentration of 210 mg/L | 76 |
| 3 | Calcium chloride solution with concentration of 2100 mg/L | 760 |
| 4 | Distilled water | — |
| 5 | Calcium chloride solution with concentration of 10 mg/L | 3.6 |

(h) Formation of Intermediate Layer (Undercoat Layer)

Undercoating solution 1 containing a composition described below was coated on the support for a lithographic printing plate 1 to 5 obtained in the foregoing manner, and dried at a temperature of 80° C. for 15 sec, to form a layer. The coating amount after drying was 15 mg/M$^2$.

<Undercoating Solution 1 Composition>

| | |
|---|---|
| high-molecular compound described below | 0.3 g |
| methanol | 100 g |
| water | 1 g |

weight-average molecular weight $M_W$ 28,000

-continued

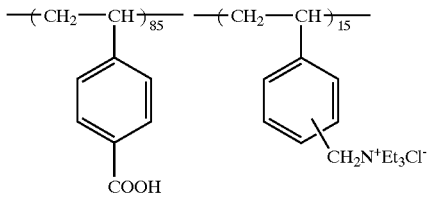

(i) Formation of Photosensitive Layer

Subsequently, photosensitive layer coating solution 1 having a composition described below was prepared and, the photosensitive layer coating solution 1 was coated over the supports for lithographic printing plates 1 to 5 having the undercoat layer formed thereon, so that the amount after drying (the coating amount of photosensitive layer) meets 1.5 g/m$^2$. Then, drying was carried out in order to form a photosensitive layer (conventional positive working type). In this way, the presensitized plates 1 to 5 were obtained.

<Composition of Photosensitive Layer Coating Solution 1>

| | |
|---|---|
| novolac resin (m-cresol/p-cresol = 60/40, weight-average molecular weight 7,000, and containing 0.5 wt % of unreacted cresol) | 1.0 g |
| cyanine dye A having a structural formula described below | 0.1 g |

cyanine dye A

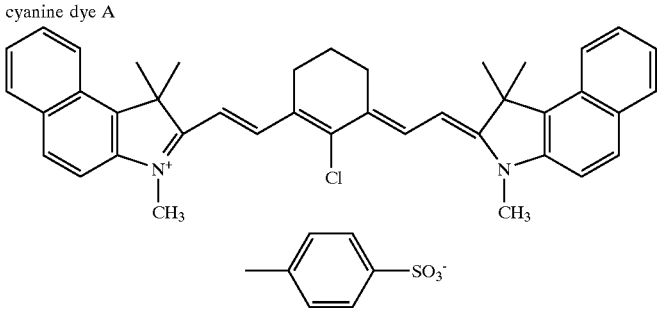

| | |
|---|---|
| tetrahydrophathalic anhydride | 0.05 g |
| p-toluenesulfonic acid | 0.002 g |
| compound prepared by setting a counter ion of ethyl violet as 6-hydroxy-β-naphthalene sulfonic acid | 0.02 g |
| fluorine-containing surfactant (Megaface F-177, manufactured by Dainippon Ink and Chemicals Inc.) | 0.05 g |
| methyl ethyl ketone | 12 g |

Example 4 to 6 and Comparative Example 3 and 4

Undercoating solution 1 containing a composition described above was coated on the supports for lithographic printing plates 1 to 5 obtained in the foregoing manner, and dried at a temperature of 80° C. for 15 sec, to form a layer. The coating amount after drying was 15 mg/m$^2$.

Subsequently, photosensitive layer coating solution 2 having a composition described below was prepared and, the photosensitive layer coating solution 2 was coated over the supports for lithographic printing plates 1 to 5 having the undercoat layer formed thereon, so that the amount after drying (the coating amount of photosensitive layer) meets 1.2 g/m$^2$. Then, drying was carried out in order to form a photosensitive layer (thermal positive working type). In this way, the presensitized plates 6 to 10 were obtained.

<Composition of Photosensitive Layer Coating Solution 2>

| | |
|---|---|
| polymer containing fluorine indicated in structural formula shown below | 0.03 g |

polymer containing fluorine

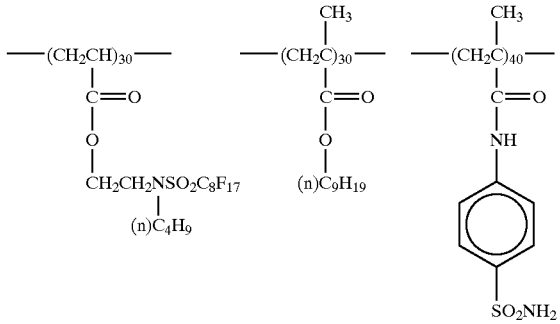

| | |
|---|---|
| particular copolymer 1 mentioned later | 0.75 g |

-continued

| | |
|---|---|
| novolac resin (m-cresol/p-cresol = 60/40, weight-average molecular weight 4,500, containing unreacted cresol 0.5 wt %) | 0.25 g |
| p-toluenesulfonic acid | 0.003 g |
| tetrahydrophthalic anhydride | 0.03 g |
| cyanine dye A | 0.017 g |
| dye prepared by setting a counter ion of Victorian pure blue BOH (manufactured by Hodogaya Chemical Co.) as 1-naphtalene sulfonic acid anion | 0.015 g |
| 3-methoxy-4-diazophnylamin hexafluorophosphate | 0.02 g |
| n-dodecyl stearate | 0.03 g |
| fluorine type surfactant (Megaface F-177, manufactured by Dainippon Ink and Chemicals Inc.) | 0.05 g |
| γ-butyrolactone | 10 g |
| methyl ethyl ketone | 10 g |
| 1-methoxy-2-propanol | 8 g |

<Particular Copolymer 1>

Methacrylic acid 31.0 g (0.36 mol), ethyl chloroformate 39.1 g (0.36 mol) and acetonitrile 200 mL were put in a 500 mL-capacity three-neck flask having an agitator, a cooling pipe and a dropping funnel, and a mixture was agitated while being cooled in an ice-water bath. Triethylamine 36.4 g (0.36 mol) was dropped to this mixture with the dropping funnel for about 1 hour. After the end of the dropping, the ice-water bath was removed and the mixture was agitated at a room temperature for 30 min.

Then, p-aminobenzene sulfonamide 51.7 g (0.30 mol) was added to the reactive mixture, and agitated for 1 hour while being heated to 70° C. in an oil bath. After the end of the reaction, the mixture was thrown into water 1 L while agitating the water, and the obtained mixture was agitated for 30 min. The mixture was filtered to remove deposition. After this deposition was turned into a slurry in water 500 mL, the slurry was filtered and, by drying an obtained solid, a white solid containing N-(p-aminosulfonyl phenyl) methacrylamide was obtained (yield 46.9 g).

Subsequently, N-(p-aminosulfonyl phenyl) methacrylamide 4.61 g (0.0192 mol), ethyl methacrylate 2.94 g (0.0258 mol), acrylonitrile 0.80 g (0.015 mol) and N,N-dimethyl acetamide 20 g were put in a 100 mL-capacity three-neck flask having an agitator, a cooling pipe and a dropping funnel. Then, a mixture was agitated while being heated to 65° C. in a hot-water bath. "V-65" (by Wako Pure Chemical Industries, Ltd.) 0.15 g was added to the mixture, and the mixture was agitated under a nitrogen gas flow for 2 hours while being maintained at 65° C. To this reactive mixture, the mixture of N-(p-aminosulfonyl phenyl) methacrylamide 4.61 g, ethyl methacrylate 2.94 g, acrylonitrile 0.80 g, N,N-dimethyl acetamide and "V-65" 0.15 g was further dropped with the dropping funnel for 2 hours. After the end of the dropping, the obtained mixture was further agitated at 65° C. for 2 hours. After the end of the reaction, methanol 40 g was added to the mixture, and cooled. The obtained mixture was then thrown into water 2 L while agitating the water. After the mixture was agitated for 30 min, deposition was removed by filtering, and the deposition was dried. Thus, a particular copolymer 1 which is a white solid of 15 g was obtained.

The weight-average molecular weight of the obtained particular copolymer 1 was measured by gel permeation chromatography (GPC), and it was 54,000 (polystyrene standard).

Example 7 to 9 and Comparative Example 5 and 6

Undercoating solution 1 containing a composition described above was coated on the support for lithographic printing plates 1 to 5 obtained in the foregoing manner, and dried at a temperature of 90° C. for 60 sec, to form a layer. The coating amount after drying was 15 mg/m$^2$.

Further, a photosensitive layer coating solution 3A having a composition mentioned below was prepared, and the photosensitive layer coating solution 3A was coated on undercoated supports for lithographic printing plates 1 to 5 so that coating quantity after dried was 0.8 g/m$^2$, and then was dried for 2 minutes at 100° C. to form (A) layer. Then, a photosensitive layer coating solution 3B having composition mentioned below was prepared, and the photosensitive layer coating solution 3B was coated so that total coating quantity (coating quantity of photosensitive layer) after dried was 1.0 g/m$^2$, and then was dried for 2 minutes at 100° C. to form a (B) layer. Then, presensitized plates 11 to 15 having a photosensitive layer (thermal positive working type) composed of two layers (A) layer and (B) layer were obtained.

<Composition of Photosensitive Layer Coating Solution 3A>

| | |
|---|---|
| particular copolymer 1 mentioned above | 0.75 g |
| cyanine dye A | 0.04 g |
| p-toluenesulfonic acid | 0.002 g |
| tetrahydrophthalic anhydride | 0.05 g |
| dye prepared by setting a counter ion of Victorian pure blue BOH (manufactured by Hodogaya Chemical Co.) as 1-naphtalene sulfonic acid anion | 0.015 g |
| fluorine type surfactant (Megaface F-177, manufactured by Dainippon Ink and Chemicals Inc.) | 0.02 g |
| γ-butyrolactone | 8 g |
| methyl ethyl ketone | 7 g |
| 1-methoxy-2-propanol | 7 g |

<Composition of Photosensitive Layer Coating Solution 3B>

| | |
|---|---|
| novolac resin (m-cresol/p-cresol = 60/40, weight-average molecular weight 4,500, containing unreacted cresol 0.5 wt %) | 0.25 g |
| cyanine dye A | 0.05 g |
| n-dodecyl stearate | 0.02 g |
| fluorine type surfactant (Megaface F-177, manufactured by Dainippon Ink and Chemicals Inc.) | 0.05 g |
| methyl ethyl ketone | 15 g |

Example 10 to 12 and Comparative Example 7 and 8

Treatment was continuously carried out by using JIS A1050 aluminum plates having a thickness of 0.24 mm and a width of 1030 mm as described below.

(a) Mechanical Graining

Mechanical graining was carried out by rotating roller-like nylon brushes while supplying suspension containing abrasive (pumice powder) having specific gravity of 1.12 and water as abrasive slurry to the surface of the aluminum plate. The abrasive had average particle size of 40 to 45 μm and maximum particle size of 200 um. A material for the nylon brush was 6–10 nylon, having a bristle length of 50 mm, and a bristle diameter of 0.3 mm. The nylon brush was made by boring holes in a ϕ 300 mm stainless cylinder and densely implanting bristles therein. Three of such rotary brushes were prepared. Each distance between two supporting rollers (ϕ 200 mm) in the lower part of the brush was 300 mm. Each brush roller was pressed until a load of a driving motor for rotating the brush reached plus 7 kW with respect to the load before the brush roller was pressed to the aluminum plate. The rotating direction of each brush was the same as the moving direction of the aluminum plate. Rotating speed of brushes was 200 rpm.

(b) Alkali Etching

The aluminum plate obtained in the foregoing manner was subjected to spray etching by using aqueous solution containing 2.6 wt % of sodium hydroxide and 6.5 wt % of aluminum ions at a temperature of 70° C., and the aluminum plate was dissolved by 13 g/m$^2$. Then, the aluminum plate was washed by water spraying.

(c) Desmutting

The aluminum plate was subjected to spray desmutting treatment in aqueous solution of nitric acid 1 wt % (containing 0.5 wt % of aluminum ions), and then washed by water spraying. For the aqueous solution of nitric acid used in the desmutting treatment, waste solution generated in the process of electrochemical graining carried out by using an alternating current in the aqueous solution of nitric acid was utilized.

(d) Electrochemical Graining

Electrochemical graining treatment was continuously carried out by using an AC voltage of 60 Hz. Electrolytic solution in this case was the aqueous solution of nitric acid 1 wt % (containing aluminum ions 0.5 wt % and ammonium ions 0.007 wt %), and the temperature was 50° C. By using an AC power supply whose waveform was a trapezoidal wave with the time TP necessary for a current value to reach its peak from zero set at 2 msec, and duty ratio set at 1:1, the electrochemical graining treatment was carried out while carbon electrodes were set as counter electrodes. Ferrite was used for an auxiliary anode. Two electrolytic cells were used.

A current density was 30 A/dm$^2$ at a current peak value. Regarding the quantity of electricity, the total of the quantity of electricity was 180 C/dm$^2$ when the aluminum plate was at the anode side. An amount equivalent to 5% of a current flowing from a power source was diverted to the auxiliary anode.

Then, the aluminum plate was washed by water spraying.

(e) Alkali etching

The aluminum plate was subjected to spray etching by using aqueous solution containing 26 wt % of sodium hydroxide and 6.5 wt % of aluminum ions at a temperature of 70° C. The aluminum plate was dissolved by 1.3 g/m$^2$, a smut component mainly containing aluminum hydroxide generated in the previous stage of the electrochemical graining carried out by using the alternating current was removed, and the edge portion of a formed pit was dissolved to be made smooth. Then, the aluminum plate was washed by water spraying.

(f) Desmutting

The aluminum plate was subjected to spray desmutting in aqueous solution of sulfuric acid 25 wt % (containing 0.5 wt % of aluminum ions) at a temperature of 60° C. Then, the aluminum plate was washed by water spraying.

(g) Anodizing

By using the anodizing device (each of first and second electrolytic portions has a length of 6 m, each of first and second power supply units has a length of 3 m, and each of first and second power supply electrodes has a length of 2.4 m) of a two-stage power supply electrolytic method, anodizing was carried out. Electrolytic solution supplied to each of the first and second electrolytic portions was sulfuric acid. Concentration of sulfuric acid for each of electrolytic portions was 100 g/L (containing aluminum ions 0.5 wt %), the temperature was 20° C., specific gravity was 1.1, and electric conductivity was 0.39 S/cm. Then, the aluminum plate was washed by water spraying. The amount of oxide layer was 2.4 g/m$^2$ at the end.

(h) Silicate Treatment

An aluminum support obtained by performing anodizing treatment was dipped in sodium silicate solution with 1 wt % of concentration and 20° C. of temperature for 10 seconds for silicate treatment, and after that the aluminum support was washed by spraying using any one of washing water 1 to 5 shown in Table 1 to obtain supports for lithographic printing plates 6 to 10.

(i) Formation of Back Coat Layer

A back coat layer coating liquid to be described later was coated, with a bar coater, on the reverse side (for which graining surface treatment was not performed) of the support for the lithographic printing plate obtained as mentioned above, and was dried for 1 minute at 100° C. to form a back coat layer. The coated quantity of the back coat layer after dried was 60 mg/m$^2$.

<Back Coat Layer Coating Liquid>

At first, a sol-gel reaction liquid having composition described below was prepared. The sol-gel reaction liquid generated heat in about 35 minutes after mixing and agitating each component. Therefore, it was further agitated for 40 minutes to react.

<Composition of Sol-Gel Reaction Liquid>

| | |
|---|---|
| tetraethyl-silicate | 50.0 part by weight |
| water | 86.4 part by weight |
| methanol | 10.8 part by weight |
| phosphoric acid (85 wt %) | 0.08 part by weight (as cast) |

Next, the sol-gel reaction liquid obtained and a diluent having the following composition were mixed to obtain a back coat layer coating liquid.

<Composition of the Diluent>

| | |
|---|---|
| pyrogallol acetone condensation resin | 15.0 part by weight |
| dibutyl maleate | 5.0 part by weight |
| methanol silica sol (manufactured by Nissan Chemical Industries, Ltd.) | 70.0 part by weight |
| fluorine type surfactant (Megaface F-177, manufactured by Dainippon Ink and chemicals, Inc.) | 0.1 part by weight |
| methanol | 650 part by weight |
| 1-methoxy-2-propanol | 200 part by weight |

(j) Formation of Organic Interlayer

An organic interlayer coating liquid having a composition described below was coated on a surface (for which graining treatment was performed) of the support for the lithographic printing plate on which a back coat layer was formed, and was dried at 100° C. for 10 seconds to form an organic interlayer. Coated quantity of the organic interlayer after dried was 4 mg/m$^2$.

<Composition of Organic Interlayer Coating Liquid>

| | |
|---|---|
| high-molecular compound mentioned below | 0.15 part by weight |
| methanol | 100.0 part by weight |

number-average molecular weight $M_n$ 2100

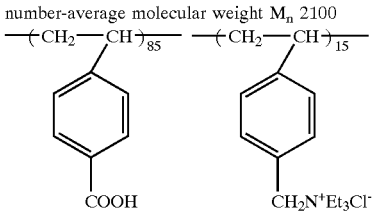

(k) Formation of Photosensitive Layer

A photosensitive layer coating solution having a composition mentioned below was coated, with a bar coater on the organic interlayer of the support for the lithographic printing plate, and was dried for 45 seconds at 120° C. to form a photosensitive layer (thermal positive working type). Coated quantity (coated quantity of photosensitive layer) after dried was 1.25 g/m$^2$. <Composition of Photosensitive Layer Coating Solution 4>

| | |
|---|---|
| esterified matter of 1,2-diazonaphtoquinone-5-sulfonil-chloride and pyrogallol-acetone resin (one described in Example 1 of U.S. Pat. No. 3,635,709) | 0.8 part by weight |
| cresol-formaldehyde novolac resin (metha/para = 60/40, weight-average molecular weight 8,000, number-average molecular weight 2,700, containing unreacted cresol of 0.8 wt %) | 1.2 part by weight |
| phenol-formaldehyde novolac resin (weight-average molecular weight 10,000, number-average molecular weight 1,400, containing unreacted phenol of 0.8 wt %) | 0.5 part by weight |
| other resin besides novolac resin indicated in a structural formula shown below (weight-average molecular weight 50,000) | 0.5 part by weight |

resin besides novolac resin

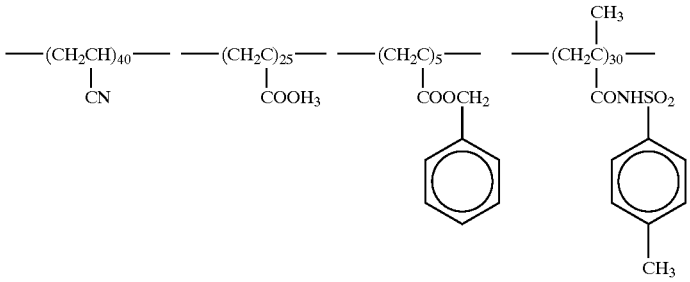

| | |
|---|---|
| naphthoquinone-1,2-diazido-4-sulfonic acid chloride | 0.1 part by weight |
| Tetrahydro-phtalic anhydride | 0.15 part by weight |
| 4-[p-N-(p-hydroxybenzoil) aminophenyl]-2,6-bis (trichloro methyl)-S-triazine | 0.1 part by weight |
| dye prepared by setting a counter ion of Victorian pure blue BOH (manufactured by Hodogaya Chemical Co.) as 1-naphtalene sulfonic acid anion | 0.1 part by weight |
| dye (I) indicated in a structural formula shown below | 0.04 part by weight |

dye (I)

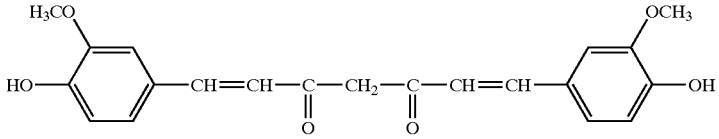

| | |
|---|---|
| methyl ethyl ketone | 30.0 part by weight |
| 1-methoxy-2-propanol | 15.0 part by weight |
| compound A containing fluoroaliphatic group mentioned below | 0.05 part by weight |
| compound B containing fluoroaliphatic group mentioned below | 0.07 part by weight |
| Fluorine type surfactant (Megaface F-177, manufactured by Dainippon Ink and Chemical, Inc.) | 0.005 part by weight |

<Compound A Containing Fluoroaliphatic Group>

25.6 g of a compound (a) indicated in a formula shown below, 26.4 g of a compound (b) indicated in a formula shown below, 20.4 g of lauryl methacrylate and 20.4 g of dimethylacetoamide were put in a 500 mL three neck flask and they were kept under 65° C. while being agitated in a nitrogen flow. Further, 2.30 g of 2,2-azobis (2,4-dimethylvaleronitrile) was added, and agitating was continued. 4 hours later, it was heated to be 75° C. and was kept for 1 hour. After the reaction was completed, it was cooled to room temperature, and the reacted liquid was poured into 400 mL of water. Precipitated solid was taken out by filtration and was dried to obtain 68.4 g of a compound A containing a fluoroaliphatic group.

Weight-average molecular weight of the obtained compound A containing a fluoroaliphatic group was measured with GPC, and it was 40,000 (polystyrene standard).

compound (a)

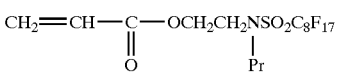

-continued compound (b)

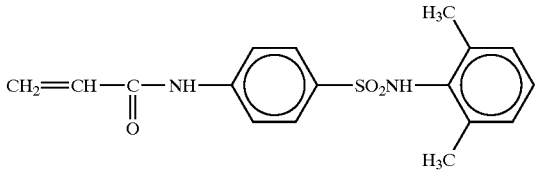

<Compound B Containing a Fluoroaliphatic Group>

117 g of methyl isobutyl ketone was put into a 500 mL three neck flask having a agitator, a cooling pipe and a dropping funnel and was heated in a hot water bath to 75° C. Then, a mixture of 36.0 g of a compound (c) indicated in a formula shown below, 27.0 g of a compound (d) indicated in a formula shown below, 12.0 g of 2-hydroxyethyl methacrylate, 25.0 g of methyl methacrylate, 117 g of methyl isobutyl ketone and 1.15 g of V-601 (manufactured by Wako Pure chemical Industries, Ltd.) was dropped with the dropping funnel in a nitrogen flow spending 2 hours. After completing the dropping, it was agitated at 75° C. for 2 hours and was further agitated at 90° C. for 2 hours. Thus, a compound B containing a fluoroaliphatic group was obtained.

Weight-average molecular weight of the compound B containing a fluoroaliphatic group obtained was measured with GPC, and it was 35,000 (polystyrene standard).

compound (c)

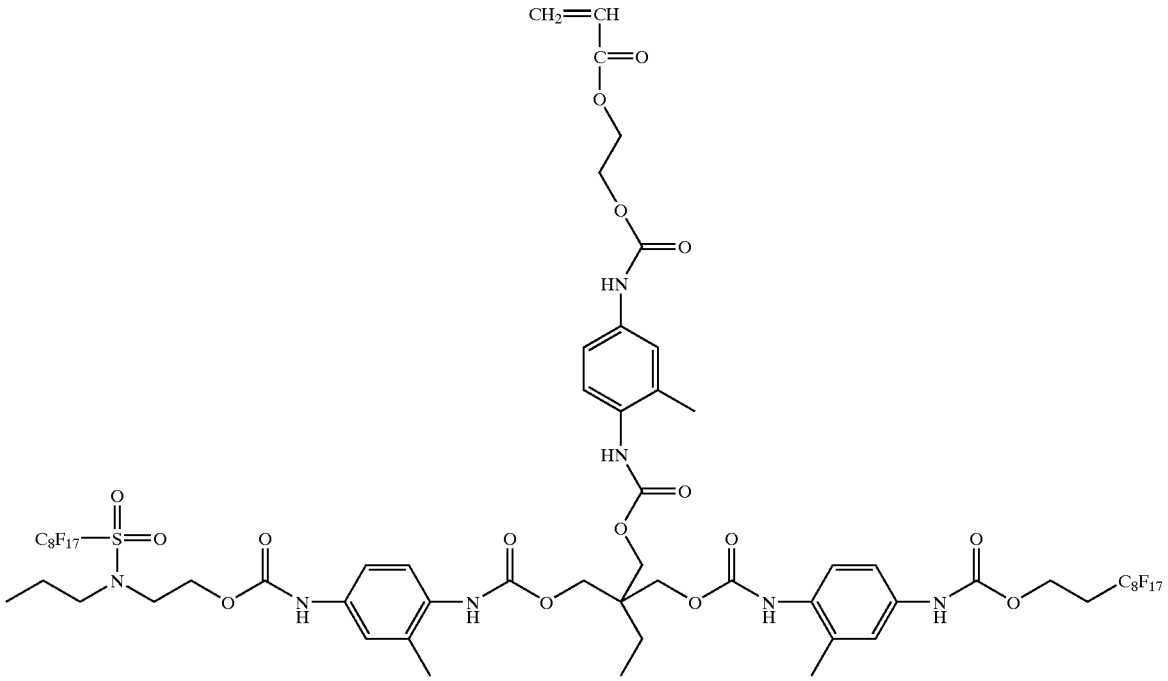

compound (d)

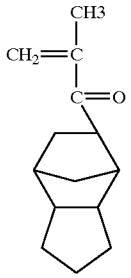

(1) Formation of Matte Layer

A resin liquid for forming a matte layer having a composition shown below was coated on a photosensitive layer using a rotary spray electrostatic coating machine at 15,000 rpm of rotary speed of the spray head, at 65 mL/minute of sending liquid quantity of the resin liquid for forming a matte layer, at −75 kV of impressed voltage to the spray head, at 25° C. of circumference temperature during the coating, at 50% of relative humidity during the coating. In 1.5 seconds after coating, the liquid was sprayed on the coated surface for wetting, and further 3 seconds later, warm air with temperature of 60° C. and humidity of 10% was sprayed for drying to form a matte layer, and presensitized plates 16 to 20 were obtained. Coated quantity of the matte layer after dried was 130 mg/m$^2$.

<Resin liquid for Forming Matte Layer>

| | |
|---|---|
| water solution of 16.5 wt % of polymer of methyl methacrylate/ethyl acrylate/methacrylic acid (charged mass rate 65/20/15) having sodium salt partly | 180 part by weight (as cast) |
| dye (II) indicated in the following structural formula | 0.2 part by weight |

dye (II)

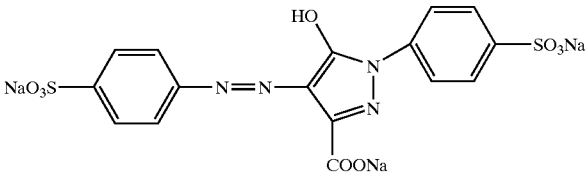

| | |
|---|---|
| polycondensation product(PX3035, manufactured by Dai-ichi Kogyo Seiyaku Co., Ltd., weight-average molecular weight 80,000) of polyethylene-polypropylene oxide polymer (weight-average molecular weight 13,000) and phthalic acid | 2.0 part by weight |

2. Measurement of Mass of Ca Atoms and Si Atoms (Ca Quantity and Si Quantity) Per Unit Area on Surface of Support for Lithographic Printing Plate and Calculation of Atom Ratio (Ca/Si).

Ca quantity and Si quantity on each surface of the supports for the lithographic printing plates 1 to 10 were measured with X-ray fluorescence analysis equipment by an analytical curve method. As standard samples for making analytical curves, for Ca, a $CaCO_3$ standard solution for atomic absorption spectrometry was used, and for Si, one prepared by drying a sodium silicate water solution containing a known quantity of Si atoms after being dropped evenly onto an area of 30 mmϕ on an aluminum base plate was used.

Conditions for X-ray fluorescence analysis of Ca are indicated below.

X-ray fluorescence analysis equipment: RIX3000 manufactured by Rigaku Industrial Corporation, X-ray tube: Rh, measuring spectrum: Ca-Kα, tube voltage: 50 kV, tube electric current: 50 mA, slit: COARSE, spectrum crystal :GE, detector: F—PC, analytical area: 30 mmϕ, peak position (2 θ): 61.95 deg., background (2θ): 60.00 deg. and 64.00 deg., integrated time: 40 seconds/sample.

Conditions for X-ray fluorescence analysis of Si are indicated below.

X-ray fluorescence analysis equipment: RIX3000 manufactured by Rigaku Industrial Corporation, X-ray tube: Rh, measuring spectrum: Si-Kα, tube voltage: 50 kV, tube current: 50 mA, slit: COARSE, spectrum crystal :RX4, detector: F—PC, analytical area: 30 mmϕ, peak position (2 θ): 144.75 deg., background (2θ): 140.70 deg. and 146.85 deg., integrated time: 80 seconds/sample.

Then, Ca /Si was calculated from the Ca quantity and the Si quantity obtained as mentioned above.

Measuring results of the Ca quantity, the Si quantity and the Ca/Si on the surfaces of the supports for the lithographic printing plates are shown in Table 2.

The Ca/Si (ratio of the number of atoms) on the surfaces of the supports for the lithographic printing plates 1 to 3 and 6 to 8 is in the range of 0.1 to 0.95, which corresponds to the first aspect of the present invention, and also the Ca quantity on each surface is in the range of 1 $mg/m^2$ or more, which corresponds to the second aspect of the present invention.

On the other hand, the supports for the lithographic printing plates 4, 5, 9 and 10 do not correspond to the present invention.

TABLE 2

| Support for lithographic printing plate | Washing water used for preparation | Ca Quantity ($mg/m^2$) | Si Quantity ($mg/m^2$) | Ca/Si (ratio of the number of atoms) |
|---|---|---|---|---|
| 1 | 1 | 2.5 | 4.0 | 0.44 |
| 2 | 2 | 3.2 | 4.0 | 0.56 |
| 3 | 3 | 5.1 | 4.0 | 0.89 |
| 4 | 4 | 0.1 | 4.0 | 0.02 |
| 5 | 5 | 0.4 | 4.0 | 0.07 |
| 6 | 1 | 1.1 | 1.6 | 0.48 |
| 7 | 2 | 1.3 | 1.6 | 0.57 |
| 8 | 3 | 1.6 | 1.6 | 0.70 |
| 9 | 4 | 0.1 | 1.6 | 0.04 |
| 10 | 5 | 0.2 | 1.6 | 0.09 |

3. Exposure and Development of Presensitized Plates (1) The presensitized plates 1 to 5 obtained as mentioned above were exposed by using a plate setter (TrendSetter 3244F, manufactured by Creo Inc.) under the conditions of 150 rpm of rotation speed and 6 W of output so that energy quantity on the plate surfaces becomes 94 $mJ/cm^2$.

Then, 20 L of an alkali developer A having a composition indicated below was poured into a developing tank of a commercially available automatic developing equipment having a dipping-type developing tank (LP-900H, manufactured by Fuji Photo Film Co. Ltd.) and was kept at 30° C. 8 L of tap water was poured in the second tank of LP-900H, and 8 L of a finishing gum solution, which was prepared by diluting FP-2W (manufactured by Fuji Photo Film Co., Ltd) using water at 1:1, was poured in the third tank. The presensitized plates exposed to light were developed with this automatic developing equipment to obtain lithographic printing plates 1 to 5.

<Composition of Alkali Developer A>

| | |
|---|---|
| $SiO_2.K_2O$ ($K_2O/SiO_2$ = 1/1 (mol ratio)) | 4.0 wt % |
| citric acid | 0.5 wt % |
| polyethylene glycol (weight-average molecular weight 1,000) | 0.5 wt % |
| water | 95.0 wt % |

(2) The presensitized plates 6 to 15 obtained as mentioned above were exposed and developed in the same manner as that for the presensitized plates 1 to 5 except that alkali developer B having a composition indicated below is used instead of the alkali developer A, and thus lithographic printing plates 6 to 15 were obtained.

<Composition of Alkali Developer B>

| | |
|---|---|
| D-sorbitol | 2.5 wt % |
| sodium hydroxide | 0.85 wt % |
| diethylene triamine penta (methylene sulfonic acid) 5Na salt | 0.05 wt % |
| water | 96.6 wt % |

(3) The presensitized plates 16 to 20 obtained as mentioned above were exposed from the distance of 1 m with a 3 kW metal halide lamp through a litho-film. Then, they were developed with the PS processor 900 V manufactured by Fuji Photo Film Co.Ltd, using water diluted developer DP-4 (1:8) manufactured by Fuji Photo Film Co. Ltd, for 12 seconds at 30° C. to obtain lithographic printing plates 16 to 20.

4. Press Life of Lithographic Printing Plate

The lithographic printing plates 1 to 20 obtained as mentioned above were printed with a printing machine (KOR-D machine manufactured by Heidelberg GmbH), and their press life was evaluated. The press life was evaluated by the number of prints at the time of being obserbed by visual inspection that the initial image quality can not be maintained. Note that no ink sticking on nonimage areas was observed during printing in the case of using any lithographic printing plate.

Results of the press life evaluation of the lithographic printing plates are shown in Table 3.

It is understood that the presensitized plates (plates 1 to 3, 6 to 8, 11 to 13 and 16 to 18) obtained by using the supports for the lithographic printing plates according to the present invention (supports 1 to 3 and 6 to 8) were not only excellent in development performance (scum resistance) but also excellent in press life when they become the lithographic printing plates (examples 1 to 12).

On the other hand, the presensitized plates (plate 4, 5, 9, 10, 14, 15, 19 and 20) obtained by using the supports for the lithographic printing plates (supports 4,5,9, and 10) in which the Ca/Si on each surface is not in the specified range and in addition Ca quantity is not specified range, were inferior in press life when they are processed into the lithographic printing plates (comparative examples 1 to 8).

TABLE 3

| | Support | Presensitized plate | Press life of lithographic printing plate(Number of impressions) |
|---|---|---|---|
| Example 1 | 1 | 1 | 50000 |
| Example 2 | 2 | 2 | 52500 |
| Example 3 | 3 | 3 | 55000 |
| Comparative Example 1 | 4 | 4 | 30000 |
| Comparative Example 2 | 5 | 5 | 35000 |
| Example 4 | 1 | 6 | 70000 |
| Example 5 | 2 | 7 | 70000 |
| Example 6 | 3 | 8 | 75000 |
| Comparative Example 3 | 4 | 9 | 35000 |
| Comparative Example 4 | 5 | 10 | 37500 |
| Example 7 | 1 | 11 | 55000 |
| Example 8 | 2 | 12 | 57500 |
| Example 9 | 3 | 13 | 57500 |
| Comparative Example 5 | 4 | 14 | 32500 |
| Comparative Example 6 | 5 | 15 | 35000 |
| Example 10 | 6 | 16 | 57500 |
| Example 11 | 7 | 17 | 60000 |
| Example 12 | 8 | 18 | 60000 |
| Comparative Example 7 | 9 | 19 | 30000 |
| Comparative Example 8 | 10 | 20 | 32500 |

What is claimed is:

1. A support for a lithographic printing plate, which is obtained by performing at least anodizing treatment and silicate treatment on an aluminum plate, wherein a ratio of the number of atoms of alkali-earth metal and silicon existing on a surface thereof is 0.1 to 0.95.

2. The support for the lithographic printing plate according to claim 1, wherein water treatment is performed using water containing 5 ppm or more of alkali-earth metal after said silicate treatment.

3. A support for a lithographic printing plate, which is obtained by performing at least anodizing treatment and treatment for water wettability on an aluminum plate, wherein 1 $mg/m^2$ or more of alkali-earth metal exists on a surface thereof.

4. A presensitized plate comprising the support for a lithographic printing plate according to claim 1 and a photosensitive layer thereof.

5. A presensitized plate comprising the support for a lithographic printing plate according to claim 2 and a photosensitive layer thereof.

6. A presensitized plate comprising the support for a lithographic printing plate according to claim 3 and a photosensitive layer thereof.

* * * * *